United States Patent [19]

Hamilton

[11] 4,333,299

[45] Jun. 8, 1982

[54] FORM FILL AND SEAL PACKAGE MAKING

[76] Inventor: Joel A. Hamilton, 101 Hardenburgh Ave., Demarest, N.J. 07627

[21] Appl. No.: 199,229

[22] Filed: Oct. 21, 1980

Related U.S. Application Data

[63] Continuation-in-part of Ser. No. 33,844, Apr. 27, 1979, abandoned.

[51] Int. Cl.[3] ..... B65B 9/04; B65B 9/08

[52] U.S. Cl. ..... 53/450; 53/555; 53/553

[58] Field of Search ..... 53/450, 451, 452, 546, 53/553, 554, 555, 373, 551, 562, 563, 479

[56] References Cited

U.S. PATENT DOCUMENTS

| | | | |
|---|---|---|---|
| 2,162,230 | 6/1939 | Salfisberg | 53/451 |
| 2,606,412 | 8/1952 | Salfisberg | 53/451 |
| 2,940,230 | 6/1960 | Flax | 53/479 |
| 3,210,908 | 10/1965 | Samberg | 53/546 |
| 3,451,187 | 6/1969 | Massey et al. | 53/451 |
| 4,034,537 | 7/1977 | Reil et al. | 53/451 |

*Primary Examiner*—Horace M. Culver
*Attorney, Agent, or Firm*—Ralph R. Roberts

[57] ABSTRACT

There is disclosed a form, fill and seal apparatus for liquids, semi-liquids and powders. The apparatus contemplates the use of two films and the sloping of the first seal and filling station at from ten degrees to a vertical condition. Contrary to the many arrangements and apparatus showing a single film and fill apparatus, this application allows and encourages single and plural filling simultaneously of pouches formed in two films. The pouch is formed by a U-shaped seal that enables a longer seal time to be employed rather than the longitudinal sealing means often employed. The feeding tube is fixed in place and the package as it is formed and filled is advanced past the fill tube. The filled pouches have the sides bowed and/or skewed to accommodate insertion of the spout and fill contents. The open top of the formed and filled pouch, when moved from the spout, is brought from its bowed condition to a contiguous and wrinkle free condition whereat it is sealed.

14 Claims, 11 Drawing Figures

FORM FILL AND SEAL PACKAGE MAKING

This is a continuation-in-part application of my application Ser. No. 033,844 filed Apr. 27, 1979 and having the same title. With the acceptance of this application my application Ser. No. 033,844 is expressly abandoned.

BACKGROUND OF THE INVENTION

1. Field of the Invention

As classified by and in the United States Patent Office this invention is found in the General Class entitled, "Package Making" (Class 53) and the subclasses entitled, "Vertically formed, filled and sealed tubular package" (subclass 451) and the subclass "Multirow" (subclass 546).

2. Description of the Prior Art

Packaging in and by a continuous motion is very well known as well as form, filling and sealing. In prior art devices the form filling and sealing apparatus usually employs a single feeding spout or device usually disposed in a vertical attitude. One or two films are arranged to produce a tubular form which is longitudinally sealed with a transverse seal to form a pouch. Among patents of interest are U.S. Pat. No. 4,023,327 to SIMMONS issued on May 17, 1977 and U.S. Pat. No. 4,081,944 to SJOSTRAND issued on Apr. 4, 1978. In these and other patents and known apparatus the longitudinal seal is usually made with ribbons or rollers and the seal may not be as full or as secure as that made with a flat seal bar of a determined time period.

The present invention provides for the forming of a U-shaped pouch or pocket made with longitudinal and transverse seals and formed with a seal bar or U or V-shape. The pouches so formed after the sealing of the sides and transverse are then partially open and are disposed in and around a spigot or spout to provide a means for filling of the pouch. This spout means, which may be a plurality of spouts, at an angle or like angles of ten degrees or vertically greater. This spout may be a single spout or may be a plurality or like spouts which are within the pouch or pouches as formed and as to be hereinafter more fully described.

The embodiment shown provides a package formed with two films and with the formation of the U-shaped pocket around a nozzle that provides a discharge of a measured amount of material. The pocket has the sides of the dies skewed to accommodate the formation around said nozzle. After filling, the pocket is sealed at the open end by the same dies that form the empty pocket around the nozzle. The formation and sealing occur at a time when the films are at a stop or with substantially no forward movement. The filling through the nozzle is made during that time when the pocket is advanced.

The invention contemplates the use of an upper and lower film which is sealed together at their edges and transversely to form a pouch or pocket which may be "one up" or may be a plurality of pouches or pockets of like size and configuration, if desired, or may be pouches or unequal size. The size and configuration of the pouch or pocket is strictly a matter of selection but it is to be noted that the upper and lower film are moved at a determined rate and in way of a filling spout. The pocket or pouch formation is a matter of selection so that the pouches are configured and advanced with the films at a like speed.

SUMMARY OF THE INVENTION

This invention may be summarized, at least partially, with reference to its objects. It is an object of this invention to provide, and it does provide, a package form, fill and sealing apparatus in which the spout is disposed at an angle of at least fifteen degrees from the horizontal. The upper and lower films are advanced to and by the fixed spout. This spout and pouch forming seal means are timed so that after the forming seal of the upper and lower film the pouch is filled and then sealed after moving from the spout.

It is also an object of this invention to provide, and it does provide, a form, fill and seal apparatus in which fixed spouts either in a single or plural arrangements are disposed between upper and lower films which are brought to a pouch former. Probably a heat seal is used to seal the films to form the pouch around the spout or spouts after which the pouch is filled and advanced and a final seal is made.

It is a further object of this invention to provide, and it does provide, a pouch forming apparatus in which one or more pouches may be simultaneously formed by and with upper and lower film which are advanced at like speed. These films are formed into a pouch or pouches around a spout or spouts disposed from the horizontal at an angle of at least ten degrees. After the pouch or the pouches are filled each pouch is sealed with a transverse seal. Pouches may be "one up" or a plurality or pouches may be formed in the film. These pouches can be disposed at a slight angle in which the film as an assembly has the plural pockets slightly fanned so that when the pocket is opened for the insertion of material into the pouch the pouch enlargement will not displace the filled pocket from a closure of the end.

In brief, the apparatus includes a table in which a lower film is advanced with an intermittent motion and is displaced upwardly from the table then downwardly at a slope of at least fifteen degrees. An upper film is shown advanced to the other or upper side of the pouch forming apparatus and is advanced in concert and at an equal speed with the lower film. The upper and lower films are brought close to one another and then displaced at an angle of at least fifteen degrees from the horizontal.

Between these films is disposed a fixed spout or discharge apparatus. The upper and lower films are first formed into a pouch by a U-shaped seal means in which the lower transverse seal is joined with side seals to provide a three sided continuous seal to form a pouch. The upper and lower films as they are formed into the pouch are around a spout in which and through which the material to be dispensed is flowed in a controlled manner to the pouch. This pouch is already at determined or slope angle such as fifteen degrees. The upper and lower film may be a wide strip in which several pouches are simultaneously formed. After the forming and filling of a pouch, a seal is then provided to seal the pouch. Preferably the films may be heat sealed together to form a pouch. A transverse seal and the sealing mechanism for the longitudinal areas of the two films are disposed at a determined angle. This seal forming unit can be cycled to hold the sealing time in a determined interval of time which may include that portion of time used to fill the pouch.

The pouch is formed around a spout or nozzle end and the bulge of the films around this nozzle or nozzles is accommodated by the skewing of the die side walls. After filling, the advancing package is sealed by the same transverse die portions that form the longitudinal side portions. The transverse seal bars or die portions are not heated to the extent that the films will be deformed by heat thus the bulge in the pouch around the nozzle is urged to a contiguous closed condition.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a form, fill and seal apparatus as adopted for use with two films brought together and showing preferred means for forming and filling a pouch. This embodiment has been chosen for the purposes of illustration and description as shown in the accompanying drawings wherein:

BRIEF DESCRIPTION OF THE DRAWINGS

In the following description and in the claims various details are identified by specific names for convenience. These names are intended to be generic in this application. Corresponding reference characters refer to like members throughout the three figures of the drawings.

The drawings accompanying and forming part of this specification disclose details of construction for the purpose of explanation but structural details may be modified without departure from the concept and principles of the invention and the invention may be incorporated in other structural forms than shown.

DETAILED DESCRIPTION OF THE SIDE VIEW OF FIG. 1

Figures 1, 2, 3, 4:
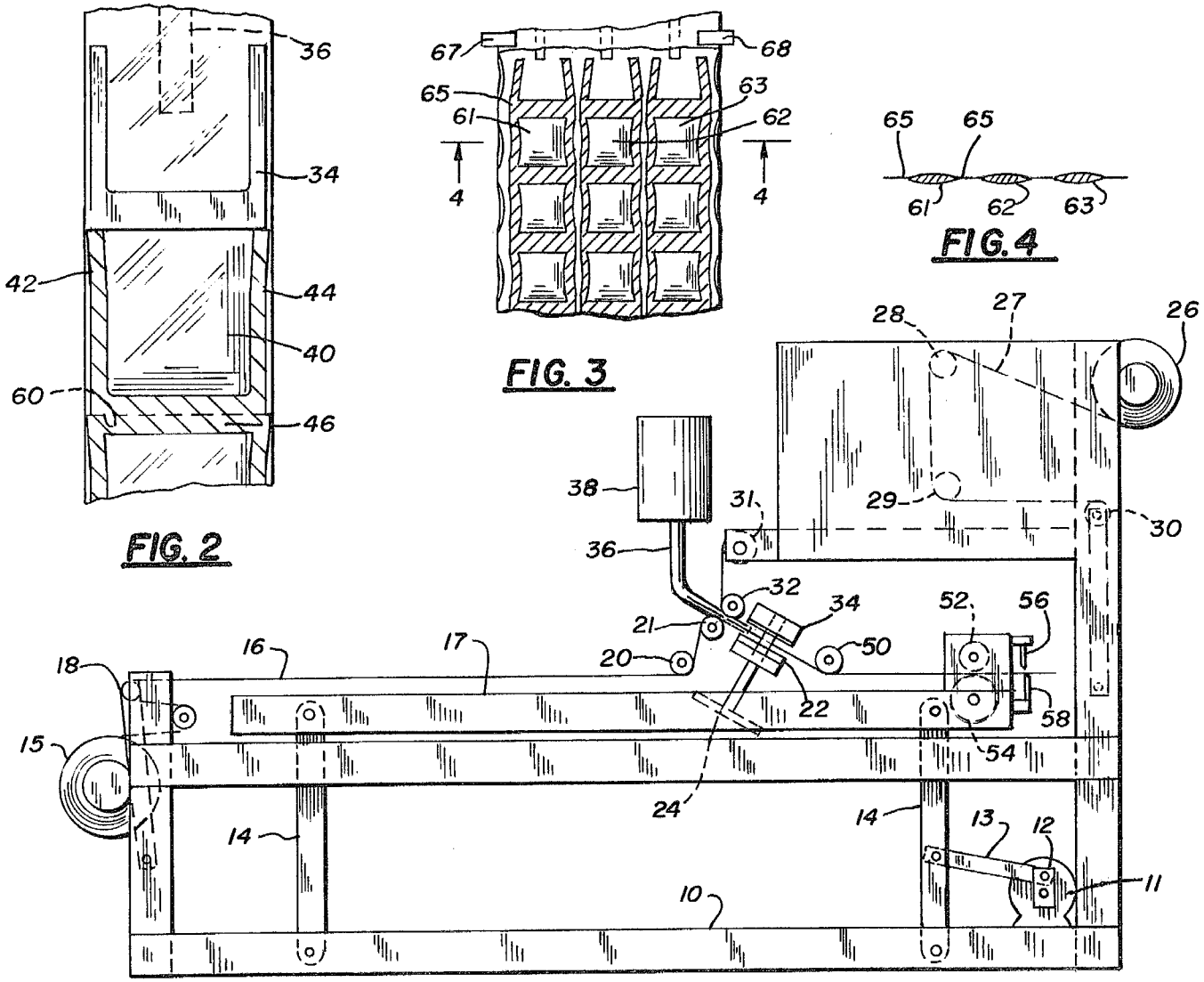
FIG. 1 represents a side view, partly diagrammatic, of a form, fill and seal apparatus and showing pouch forming means disposed at an angle such as fifteen degrees, this apparatus contemplates intermittent motion of the upper and lower films which are brought towards and to a pouch forming and filling station.
FIG. 2 represents a plan view, partly diagrammatic, and showing a pouch with a U-shaped seal.
FIG. 3 represents a fragmentary, partly diagrammatic, view and showing the upper and lower film formed into a series of pouches which may be filled simultaneously.
FIG. 4 represents a somewhat fragmentary, diagrammatic, sectional view of the plural pouch arrangement, this view depicted after filling and prior to the sealing of the pouches.

Referring now to the drawing and FIG. 1 in particular, the apparatus includes a frame 10 on which is mounted a motor 11 driving a crank arm 12. This crank arm reciprocates a pitman arm 13 which moves or cycles a plurality of support arms 14. On this frame 10 is secured a lower feed roll stand 15 which delivers the lower film 16 to a cycled frame 17. This frame is moved in response to the back and forth movement of the pitman arm 13. An idler roller 18 carries and directs the film delivered from the lower feed roll stand 15 to a lower deflecting roller 20 thence to an upper associated deflecting roller 21 by which the lower film 16 is fed to the lower surface of a film sealing die 22. This film sealing die 22 is reciprocated from an open to a closed condition by a time mechanism and by a mechanical device 24 which is cycled in response to said timing mechanism (not shown).

An upper roll film support 26 is carried by the frame 10. An upper film 27 is delivered from this support by rollers 28, 29 and 30 and is fed to a roller 31 and then to a redirecting roller 32 by and from which the upper film 27 is moved to and through the pouch forming dies. Upper forming die 34 is usually in a fixed attitude and position. The lower die 22 is cycled by a mechanical device to form the pouch by and in the two films. A spout 36 is fixedly attached to a delivery hopper 38 diagrammatically shown. This spout 36 is shown with its lower end at an angle and is brought to and between the upper and lower films.

Pouch Formation as seen in FIG. 2

As depicted in FIG. 2, the lower and upper films 16 and 27 are brought to and between the lower and upper die or seal forming means 22 and 34 to produce U-shaped pouches 40. Each pouch has longitudinal side seal portions 42 and 44 with a transverse seal 46 forming the bottom portion of the pouch. While still in a U-shape the material to be placed in the pouch is fed through spout or spouts 36 and into the interior of the pouch. This pouch encapsulates or encloses the material being delivered from the hopper 38. A metering means (not shown) is conventional and is placed within or is associated with the spout 36 so as to control the flow of material at and only for a determined period of time. After filling of the pouch, a transverse seal is formed as a part of and at the upper end of the pouch and preferably as a part of the new pouch to be formed. After sealing the encapsulated pouch is fed by and to a deflecting roller 50 and then to gripping rollers 52 and 54. The filled pouch is now fed into and through a severing or automatic cutting mechanism indicated as upper and lower knives 56 and 58. These knives are actuated in reponse to the timed advance of the filled pouches.

Multi-Pouch Forming of FIG. 3

As shown in FIG. 3, the upper and lower film may be formed with plural pouches depicted as 61, 62 and 63. These pouches are brought in way of the filling spouts 36 with at least one filling spout within each pouch. After a determined amount of material has been delivered to a pouch, end sealing mechanism is activated to close the pouch. Severing is provided to separate the pouches into a single or plurality arrangements as determined.

It is to be noted that the filled and sealed pouches are bulged at their midlength. The closed end (upper) of the filled pouches is pressed into a contiguous relationship without wrinkles as depicted and explained in detail in subsequently presented FIGS. The showing of the side portions and the closing of the upper ends is a matter of the volume and the desired configuration of the resulting package. If said resulting package is to be substantially rectangular, the accommodation of the spout size and the amount of fill determines the resulting package. The pouches are normally several in a side-by-side arrangement with simultaneous filling and sealing and subsequent severing.

Sectional View as Taken on FIG. 4

Figure 9A:
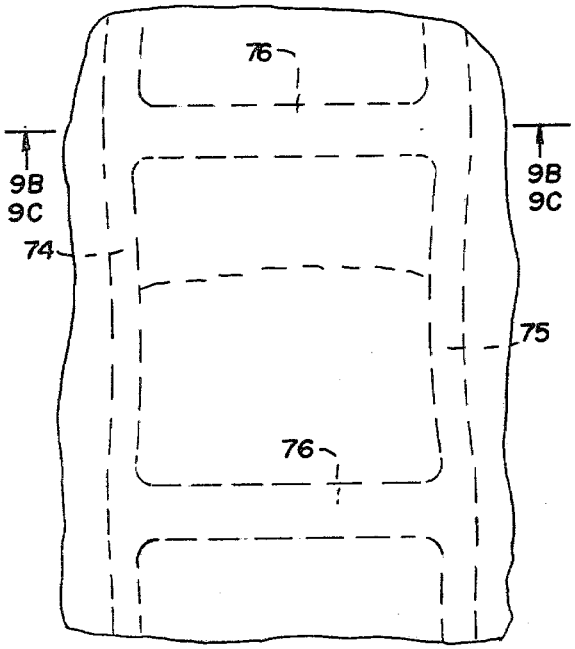
FIG. 9A represents a side view of the pouch during the closing thereof.
Figure 9B:
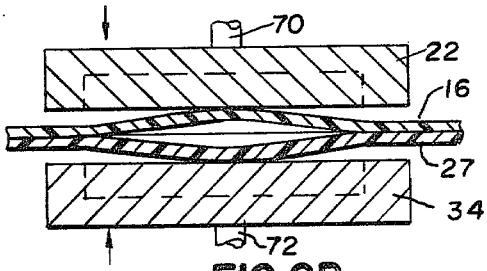
FIG. 9B represents a sectional view of the closing of the sealed pouch, this view taken on the line 9B—9B of FIG. 9A and looking in the direction of the arrows.
Figure 9C:
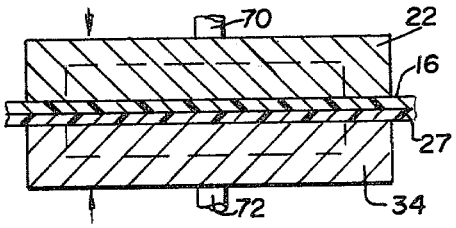
FIG. 9C represents the sectional view of FIG. 9B and with the dies moved into a sealing condition, this view taken on the line 9C—9C and looking in the direction of the arrows.

Referring next to FIG. 4 and the plural pouches identified as 61, 62 and 63, it is to be noted that each pouch is filled by material fed from a spout or spouts 36. After a determined quantity has been delivered, the pouch is moved from in way of the filling spout and a seal of the pouch end or the several pouch ends is made. It is to be noted that with the depicted arrangement the pouch top can be brought to a contiguous relationship without wrinkles after which a sealing of the pouch is made. This sealing is shown in FIGS. 9A, 9B and 9C to be hereinafter more fully described. Depending upon the quantity to be placed in each pouch and the probable bulge at the open end of the pouch, a canting of the pouch or forming of the pouch is established.

Figure 6:
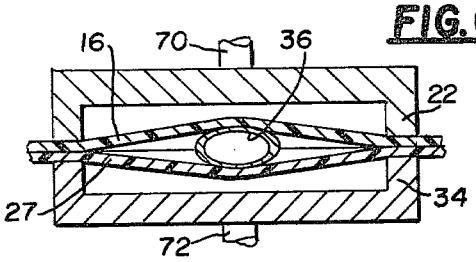
FIG. 6 represents a sectional view of the forming of the film around the nozzle as the side and bottom of the pouch are formed, this view taken on the line 6—6 of FIG. 5 and looking in the direction of the arrows.
Figure 5:
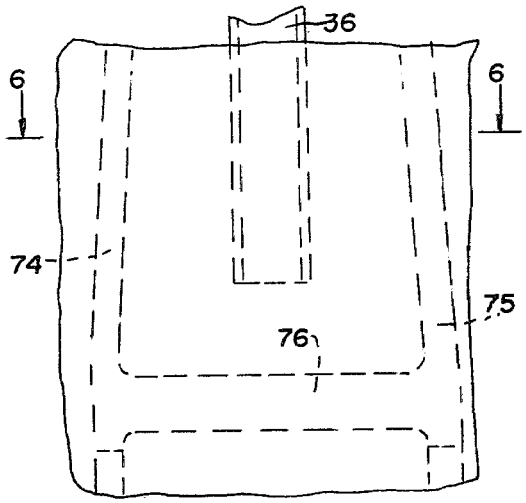
FIG. 5 represents a side view, partly diagrammatic, and in an enlarged scale and showing the formation of the pouch around the nozzle and U-shaped die.

Embodiment of FIGS. 5 and 6

In FIGS. 5 and 6 the U-shaped dies 22 and 34 may be movable by a mechanical device 24 as in FIG. 1 or may be carried and moved by cylinders not shown and having piston rods 70 and 72. The longitudinal portion of the dies are canted or skewed and are identified as 74 and 75. Said dies also have a lower transverse portion 76 which is broader than the longitudinal side portions 74 and 75. The spout or nozzle 36 is between the sides and the top and bottom films 27 and 16 which are then sealed into a U-shaped pouch around this spout. As the pouch is formed the product is fed through the spout 36 into this formed pouch.

Figure 8:
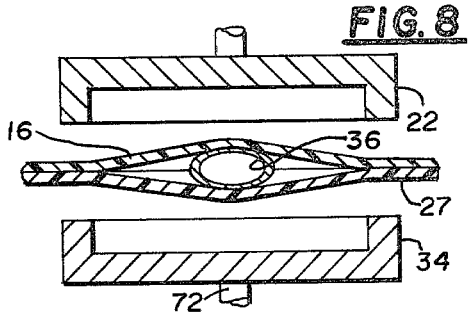
FIG. 8 represents a sectional view of the pouch around the nozzle, this view taken on the line 8—8 of FIG. 7 and looking in the direction of the arrows.
Figure 7:
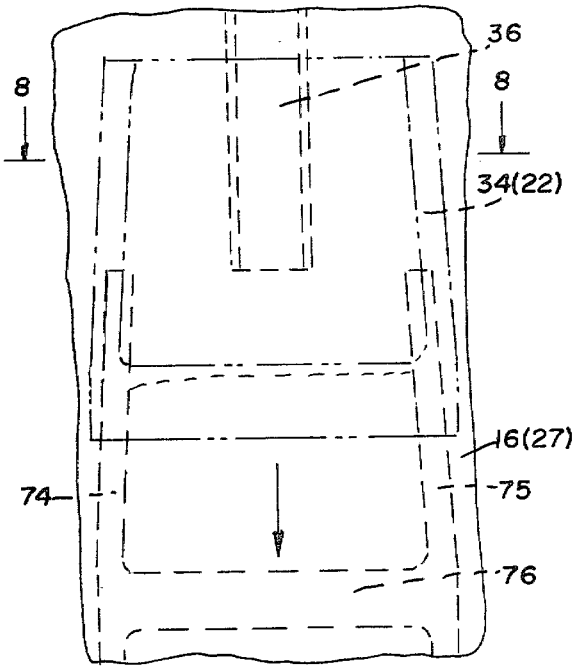
FIG. 7 represents a side view, like that of FIG. 5, but with the forming dies apart and the pouch advanced during filling.

Embodiment of FIGS. 7 and 8

In the views of FIGS. 7 and 8, the pouch is advanced as shown by the arrow. The product to be packaged is flowed into the pouch as said pouch is advanced to bring the end of the spout 36 to the open top of the pouch. As the end of the spout 36 is brought to the open top of the formed pouch the flow through the spout is terminated. As seen in FIG. 8 the dies are open when and while the pouch is being advanced and filled.

EMBODIMENT OF FIGS. 9A, 9B and 9C

Referring next and finally to FIGS. 9A, 9B and 9C, it is to be noted that the filled pouch is sealed at the top by the lower transverse portion 76. Said transverse bar portion is brought to the closed and sealing condition after the pouch has been filled and the pouch has been moved from in way of the spout 36. In FIG. 9B the films 16 and 27 are depicted as being urged or moved together by the lower transverse portion 76. The maximum bulged portions of the open top of the pouch are urged together. The dies are not heated to the extent that the films are melted or weakened. These bulged central portions are brought toward each other so that wrinkles in the film do not develop. By smoothly and quickly bringing the two portions together the secured and sealed outer portions are caused to move outwardly and the films 16 and 27 are sealed at the top of the pouch to form and provide a filled sealed pouch.

The above described drawing is more a depiction of the mechanism in operation. As shown, the lower film 15 and the upper film 27 is brought to and in the way of the pouch forming dies 22 and 34 to form a pouch or plurality of pouches in the upper and lower film. While the pouches are formed, spout 36 is opened to discharge the material into the pouch after which the pouch is moved forwardly to a sealing and severing station.

Operation of the Apparatus

The above described apparatus, although diagrammatically shown and described, is applicable to pocket forming apparatus that is disposed nominally fifteen degrees above the horizontal. The apparatus may be disposed at a vertical condition. It is to be noted that the U or V-shaped pouch is formed with a U-shaped sealing apparatus and that the pouch forming time period is accomplished at an intermittent operation of the film. Material from the hopper 38 is fed to and through the spout 36 and by means of metering apparatus not shown. The material is fed into a pouch and may be liquid, semi-liquid or a powder. After a determined amount of material has been fed, the pouch, now filled, is advanced to a sealing apparatus where a transverse seal is made to seal the pouch. If a plurality of pouches are made in the film assembly, these pouches may be two and three up or any selected number. These plural assemblies usually are formed and disposed in a side-by-side relationship for separation into several pouches after they have been formed, filled and sealed.

The pouch as formed (FIG. 3) may be slightly skewed or canted so that a side-by-side arrangement of a formed pouch will have an open end. This end is sufficiently open for the spout to be entered for filling of the product into the central portion. After the pouches are filled they are sealed to provide the desired secured quantity of contents. The depicted apparatus contemplates that the lower film may be carried on a table or surface for examination prior to the bringing of the lower film in way of the pouch forming apparatus. This is not necessarily a requirement, since the apparatus may have a lower film support very close to deflecting roller 20. The upper film 26 may be arranged at any convenient position to provide a delivery of the upper film in a timed relationship to the lower film. The sealing of the three sides of the pouch usually includes a transverse seal, after the pouch has been filled. This seal is usually made by heat and a die or dies bringing the upper and lower film together. Any type of seal may be used as long as the pouch originally formed is initially sealed on three sides and a fourth transverse seal is made after the pocket has been filled with the desired quantity of material. It is to be noted that the filling of the pouch may occur during the holding of the films in dies 22 and 34 as depicted.

Although the slope of the dies, the pouch and the film as formed into the pouches may be as little as ten degrees from the horizontal, a slope of about fifteen degrees minimum is preferred. Greater slope can and is often provided and this slope can be as much as vertical. The spout 36 is usually in a fixed attitude or condition and usually the film is moved from in way of the spout but this disclosure is not intended to preclude a spout construction or support which allows or causes the end of the spout to be moved before, at or after the filling of the pouch. When the pouches 61, 62 and 63 are made as multiples as in FIG. 3, the filled pouches may be manipulated by means not shown to cause the open ends of the filled pouches to be drawn into a determined parallel condition or attitude. When so manipulated the open ends are sealed so that no wrinkles and/or folds occur when sealing to thus create an imperfect seal of the two films. Often it is desirable that a small side space 65 between pouches be provided. This side spacing permits a stretching or tightening of the upper and lower films at the open end after a pouch or pouches have been filled with the open pouch ends appearing as in FIG. 4. The bulge in the films around the spout 36 usually is an increase of about one-sixteenth inch in length in each film panel. This is the difference from a straight line and the bow produced by the presence of the spout. This increased length is accommodated by the gripping means of FIG. 3 or by the progressive closing of the dies 74, 75 and 76 as seen in FIGS. 9A, 9B and 9C.

It is to be noted that the forming dies 22 and 34 are shown at a slight slope such as fifteen degrees. This angle, of course, anticipates that the pouch will be formed with the lower transverse seal end lower than the upper open end.

From a practical stand-point the dies are at a slope of at least fifteen degrees from the horizontal but as little as ten degrees may be provided in certain circumstances.

The lower and upper films 16 and 27 may also be arranged to form a pouch which is more-or-less vertical. When this vertical attitude is desired the hopper 38 and spout 36 are configured and arranged to bring the spout to and between these films.

The variations in film thickness, composition, laminations, as well as in the material being delivered and packaged determines the final produced package. Product packaging which includes powder often requires a vertical or near vertical attitude. The more fluid the product is the nearer to the horizontal the pouch forming and filling may be. Barrier type film such as coated foil is commonly used for fluid or semi-fluid material containing oil such as salad dressing.

A side-by-side pouch formation requires that the dies and configuration and placement of the pouch will be an individual consideration with reference to material to be packaged. Also to be considered is the quantity and speed of filling of the pouches. It is to be particularly noted that this concept allows and encourages the formation of side-by-side pouches in two films and after the filling of these pouches the top portions of the films may be drawn or pulled into substantially a paralleled and contiguous relationship for an unwrinkled sealing of the pouch.

It is to be noted in FIG. 2, that the pouch when sealed is shown as producing a small outward flare in sides 42 and 44 when accommodation and withdrawal of spout 36 is considered. This is not to preclude formation of the die sides to produce any desired finished shape. The package, the material forming the package, the contents to be packaged and the quantity to be packaged must be considered in the design and/or configuration of the dies to produce a desired contour or shape. It is also to be noted that the grippers 67 and 68 are actuated when and as the spout end 36 is withdrawn from the formed pouch. The grippers are often not employed since the sealing of the filled pouch is preferably as in FIGS. 9B and 9C.

Terms such as "left", "right", "up", "down", "bottom", "top", "front", "back" and the like are applicable to the embodiment shown and described in conjunction with the drawings. These terms are for the purposes of description and do not necessarily apply to the position in which the form, fill and sealing apparatus may be constructed or used.

I claim:

1. Apparatus for forming, filling and sealing a pouch of film in which the upper and lower films are intermittently advanced to a pouch former whereat and in which material is discharged into the formed pouch which is then sealed after a determined filling, this apparatus including:

(a) a support frame;

(b) means for supporting lower and upper films and means for intermittently advancing said films at substantially the same speed;

(c) a delivery spout fixedly supported so as to be positioned between the lower and upper films;

(d) sealing means for forming a sequential series of sealed pockets of a U or V-shape simultaneously by and with combined and opposed die means having corresponding U or V-shapes in joined lower and upper films by closing and opening said appropriately configured die means which are moved in a timed relationship to the intermittent movement of the films, said sealing of the films into formed pockets occuring when and while the movement of films is substantially stopped;

(e) means for positioning the lower and upper films as they are brought in way of said sealing means which is disposed at least at an angle or slope of at least ten degrees to a horizontal surface, said pocket formed around said spout with said pocket having its open top formed with sufficient film material so that the material forming the pocket is not stretched as the pocket is formed around the spout;

(f) means for providing a supply of material from a supply hopper during a determined time period and to the end of said delivery spout, said spout extending within the opening of the formed pocket and at least at an angle similar to the formed pocket;

(g) means for delivering a measured flow of material through said delivery spout only after the pocket has been formed by the opposed configured die means;

(h) means for sealing the open end of the pocket after filling the pocket with a determined quantity of material;

(i) means for advancing the now formed, filled and sealed product to a severing means for separating the packaged product into a desired configuration and plurality, and (j) means for delivering the separated and packaged product to an accumulating means.

2. Apparatus for forming, filling and sealing a pouch as in claim 1 in which the transverse seal to close the filled pouch is made with opposed dies which are actuated with the forming of the U or V-shaped pockets produced by the opposed dies as and with the formation of the seal to make a succeeding pouch.

3. Apparatus for forming, filling and sealing a pouch as in claim 2 in which the transverse seal for closing a pouch is made with and by the transverse seal die forming the lower transverse portion of the pouch.

4. Apparatus for forming, filling and sealing a pouch as in claim 1 in which the lower and upper films are of a sufficient width to permit and enable a plurality of side-by-side pouches to be formed as a series of pouches, each pouch as it is made with opposed formed as a series of pouches, each pouch as it is made with opposed dies which are actuated with the forming of the U or V-shaped pockets produced by the opposed dies.

5. Apparatus for forming, filling and sealing a series of side-by-side pouches as in claim 4 in which there is provided spaces between the plural side-by-side pouches and means for drawing said films including the open ends of said filled pouches and the films therebetween sufficiently taut so the said film portions are substantially contiguous and are sealed to close the open end of the pouches without wrinkles.

6. Apparatus for forming, filling and sealing a series of side-by-side pouches as in claim 5 in which the sides of the pouches are skewed so that in a filled condition the open ends of the pouches are drawn into a contiguous relationship and then the open end of the filled pouches are sealed with the film portions drawn into a parallel condition with sealing of the ends made without wrinkles.

7. Apparatus for forming, filling and sealing a pouch as in claim 1 in which the dies forming the pouch are canted so as to provide an inward skew to the sides so that after filling of the pouch and withdrawal of the spout the open end of said filled pouch is sealed by transverse die members which first engage the bulged central facing portions of the open end and then continued movement urges the portions toward each other and when said portions are together to exert sufficient pressure to flatten said opposed face portions and to then effect a seal of said end of said pouch without wrinkles.

8. Apparatus for forming, filling and sealing a pouch as in claim 7 in which the transverse sealing dies are heated to effect a heat seal of the pouch.

9. A method for forming, filling and sealing a pouch of film in which upper and lower films are intermittently advanced to a pouch former whereat and in which material is discharged into the formed pouch which is then sealed after a determined filling, this method including the steps of:

(a) arranging a support frame;

(b) supporting lower and upper films and intermittently advancing said films at substantially the same speed;

(c) fixedly supporting a delivery spout so that the delivery end is between the upper and lower films;

(d) forming a sequential series of sealed pockets of a U or V-shape simultaneously by and with combined and opposed die means having corresponding U or V-shapes in joined lower and upper films by closing and opening said appropriately configured die means which are moved in a timed relationship to the intermittent movement of the films, said sealing of the films into formed pockets occuring when and while the movement of films is substantially stopped;

(e) positioning the lower and upper films as they are brought in way of a sealing means disposed at least an angle or slope of at least ten degrees to a horizontal surface and forming said pockets around said spout with said pocket having its open top formed with sufficient film material so that the material forming the pocket is not stretched as the pocket is formed around the spout;

(f) providing a supply of material from a supply hopper during a determined time period and to a delivering spout, said spout having a delivery end at least proximate to the opening of the formed pocket and at the angle similar to that of the formed pocket;

(g) delivering a measured flow of material through said delivery spout only after the pocket has been formed by the opposed configured die means;

(h) sealing the open end of the pocket after filling the pocket with a determined quantity of material;

(h) advancing the now formed, filled and sealed product into a desired configuration, and (j) delivering the separated and packaged product to an accumulating means.

10. The method for forming, filling and sealing a pouch of film as in claim 9 which further includes using the transverse bar portion of the opposed dies to effect the closing and sealing the open end of the filled pouch.

11. The method for forming, filling and sealing a pouch as in claim 9 which includes providing upper and lower films of a sufficient width to permit and enable a plurality of side-by-side pouches to be formed as a series of pouches, each pouch as it is made with opposed dies which are actuated with the forming of the U or V-shaped pockets produced by the opposed dies.

12. The method for forming, filling and sealing a pouch as in claim 9 which further includes contouring or skewing the sides of the dies so that after filling the pouch and withdrawal of the spout a sealing of the open end of the pouch is by transverse die members which are moved to first engage the bulged central facing portions of the open end of the pouch and then with contoured movement of the dies urging the pouch portions toward and to each other continued exerting of sufficient pressure on the dies to flatten said opposed face portions and this pressure causes a sealing of said pouch end without wrinkles.

13. The method for forming, filling and sealing a pouch as in claim 12 which further includes heating said transverse portion of the dies to effect a heat sealing of the pouch.

14. The method for forming, filling and sealing a pouch as in claim 9 which includes moving the dies simultaneously toward each other.

* * * * *